United States Patent [19]

Skidmore et al.

[11] 4,316,397

[45] Feb. 23, 1982

[54] TORQUE WRENCH

[75] Inventors: Ray C. Skidmore, Chagrin Falls, Ohio; Richard H. Skidmore, Naples, Fla.

[73] Assignee: Skidmore Engineering Div. Buckeye Gear Company, Cleveland, Ohio

[21] Appl. No.: 165,546

[22] Filed: Jul. 3, 1980

[51] Int. Cl.[3] ..... B25B 23/142

[52] U.S. Cl. ..... 81/483

[58] Field of Search ..... 81/478, 483, 474; 192/94, 67 P; 285/89; 403/335, 336, 337, 46

[56] References Cited

U.S. PATENT DOCUMENTS

| | | | |
|---|---|---|---|
| Re. 25,547 | 4/1964 | Skidmore | 81/483 |
| 2,984,133 | 5/1961 | Livermont | 81/474 |
| 3,577,815 | 5/1971 | Bergquist | 81/483 |
| 3,581,606 | 6/1971 | Grabovac | 81/483 |
| 3,772,942 | 11/1973 | Grabovac | 81/483 |
| 3,890,859 | 6/1975 | Grabovac et al. | 81/474 |
| 4,079,639 | 3/1978 | Wood | 81/483 |
| 4,207,783 | 6/1980 | Grabovac | 81/483 |
| 4,244,248 | 1/1981 | Adell et al. | 409/234 |

*Primary Examiner*—James L. Jones, Jr.
*Attorney, Agent, or Firm*—Yount & Tarolli

[57] ABSTRACT

A torque wrench having a main body of fixed overall length and having a torque adjusting mechanism enclosed within the main body. The adjusting mechanism is controlled by a rotatable handle disposed about the main body. The adjusting mechanism includes a first part which is connected with the handle for joint rotation therewith, but which is constrained against axial movement. The adjusting mechanism further includes a second part having a polygonal portion extending into a polygonal recess in the first part to couple the first and second parts for joint rotation while permitting linear movement of the second part. The second part is designed to move linearly in response to joint rotation of the first and second parts in order to effect adjustment of the torque setting of the wrench. The handle contains a locking mechanism to prevent movement of the adjusting mechanism during operation of the torque wrench. The torque wrench is designed to provide for precise adjustment of the torque setting, and yet maintain a fixed wrench length, regardless of whether its torque is set, or is being adjusted.

16 Claims, 5 Drawing Figures

66
68
70
62
64
60
56
16
42
50
84
59
80
58
81
86
87
4
90
92
52
82
44
54
36

TORQUE WRENCH

BACKGROUND OF THE INVENTION

The present invention is directed to a torque wrench, particularly a predetermined adjustable torque release wrench, having a new adjusting mechanism and a new locking mechanism operatively connected to the adjusting mechanism.

DESCRIPTION OF THE PRIOR ART

Torque wrenches, particularly torque wrenches which release at a predetermined torque level, are well known. In such wrenches it is common to provide a mechanism for adjusting the torque setting at which release will occur, thus adjusting the torque transmitting capabilities of the wrench.

One such wrench is shown in U.S. Pat. No. Re 25,547. The patent discloses a wrench arm having a roller type follower which engages a camming surface of an adjustment block. The engagement of the roller follower and the camming surface on the adjustment block causes the wrench to be tripped (released) at a predetermined torque setting. An adjusting screw is rotatable to vary the effective force of a spring acting on the block. Varying the spring force on the block varies the force acting between the camming surface and the roller follower, and thus varies the torque at which the wrench will release.

Another prior art torque wrench is shown in Grabovac U.S. Pat. No. 3,890,859. The torque wrench includes a torque driver tool having a female hexagonal member attached to the handle. The handle must be moved relative to the work head to disengage splines 48, 49 in order to permit the female hexagonal member to rotate the male hexagonal member for adjusting the torque. Thus, the axial length of the tool is changed during the process of adjusting the torque.

Yet another prior art torque wrench is shown in Grabovac U.S. Pat. No. 3,581,606. The patent discloses a torque wrench with a female hexagonal member that must be withdrawn from inside the main tube body so that a ball 82 is retracted out of one of the locking grooves 80, in adjusting the torque of the driver tool.

Still another prior art torque wrench is shown in Berquist U.S. Pat. No. 3,577,815. The torque wrench includes a release mechanism having a roller 16 engaged in a semicircular recess formed by two legs 10 at the end of the wrench arm 5 connected to the wrench head. Berquist also has a locking mechanism located at the end of the wrench handle. A retaining cap 35 is threaded (at 34) to force locking pins 38 into recesses located in a cylindrical member 30. The locking pins 38 are slidably located in a holding sleeve 24.

A further example of a prior art torque wrench is shown in Kobayashi U.S. Pat. No. 3,786,699. The torque wrench of that patent includes an adjusting screw 24 threaded into a support block 18. The adjusting screw 24 is held axially stationary with respect to the wrench body by a pin 29 in a groove 26.

Finally, another example of a prior art torque wrench is Woods U.S. Pat. No. 3,016,773. The patent discloses the use of a lock ring 49 on the exterior portion of a torque wrench handle.

As discussed in some of the foregoing patents, and as known to those in the art, there has been a continuing need for torque wrench constructions which are relatively simple, and yet provide for highly accurate torque adjustment.

SUMMARY OF THE INVENTION

The torque wrench according to the present invention is believed to be simple to construct and to provide very accurate adjustment of the torque setting while maintaining a fixed overall wrench length. The torque wrench has an adjusting mechanism enclosed within a main body of fixed length, and a locking mechanism which is capable of locking the torque wrench at a selected torque setting and selectively releasing the torque setting for further adjustment. The torque wrench structure is designed to maintain an overall fixed wrench length regardless of the relative positions or operation of the locking mechanism or adjusting mechanism, and this assists in permitting more accurate torque responses.

In the torque wrench of the invention, the adjusting mechanism includes a first adjusting means mounted for relative rotational movement with respect to the main body. The first adjusting means is mounted with respect to the main body to present relative axial movement between the first adjusting means and the main body. A second adjusting means engages the first adjusting means and is operatively connected for joint rotational movement with the first adjusting means. The second adjusting means is also adapted to move axially with respect to the main body when the first and second adjusting means are rotated jointly relative to the main body.

According to the preferred embodiment, interengaging polygonally shaped male and female parts are provided for interconnecting the first and second adjusting means. Those parts include an adjusting female hexagonal part and a hexagonal male adjusting screw.

The first adjusting means (e.g., the adjusting female hex) is rotated by an adjusting handle which fits over, and rotates about, the outer surface of the main body. A locking mechanism is provided which locks the adjusting handle in an adjusted position with respect to the main body and prevents movement of the adjusting mechanism when the torque wrench is being operated.

The locking mechanism includes a locking ring located about the outer periphery of the main body and positioned so as not to interfere with the use of the torque wrench. The locking mechanism has many different settings in order to minimize the extent of any rotation of the adjustable handle relative to the main body to effect locking of the wrench in an adjusted position. Thus, the desired torque setting is not changed appreciably when locking the adjusting handle.

The locking mechanism and the adjusting mechanism of the present invention are so positioned such that the overall length of the wrench remains constant at all times. This results in a more accurate torque response by insuring that the force applied to the wrench acts through the same length. Additionally, enclosing the adjusting mechanism within the main tube body of the wrench insures that the adjusting mechanism is protected at all times, even during adjustments to the torque setting. This, of course, not only protects the adjusting mechanism from damage but also assists in keeping dirt, grease and other particles from contacting the adjusting mechanism. The locking mechanism and the adjusting mechanism are arranged so that the torque wrench of the present invention is of a simple construction and is convenient and easy to adjust.

BRIEF DESCRIPTION OF THE DRAWINGS

A more detailed understanding of the present invention can be obtained from the following description and drawings, wherein.

DESCRIPTION OF PREFERRED EMBODIMENTS

Figure 1:
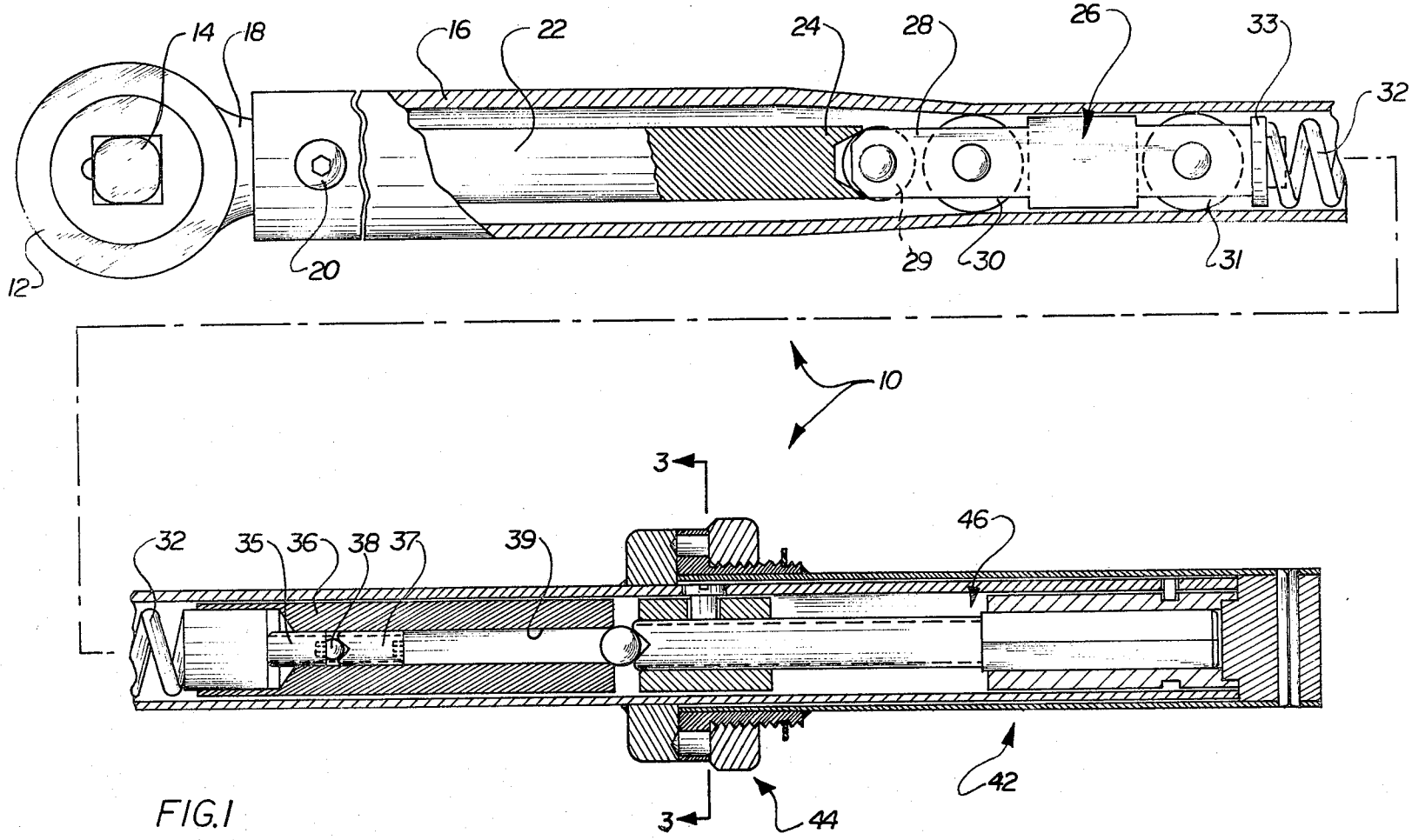
FIG. 1 is a somewhat fragmentary view of the torque wrench of the present invention with certain portions along the longitudinal axis being shown in cross section.

A torque wrench 10 in accordance with the present invention is illustrated in FIG. 1. The torque wrench illustrated in FIG. 1 is shown in fragmentary sections with certain portions shown in cross section along the longitudinal axis of the torque wrench. The particular type of torque wrench 10 illustrated is a predetermined adjustable torque release wrench which has an audible signal emitted when the predetermined torque is reached.

The wrench 10 has a wrench head or ratchet head 12, also called a work head. Projecting from the wrench head 12 is a stud 14 which is used to connect the wrench 10 to a suitable tool such as a socket.

The wrench 10 includes a main body 16 which is tubularly shaped. Extending axially down the center of the main body 16 is a wrench arm or bar 22. The wrench arm 22 is connected to the wrench head 12 at the neck portion 18. The wrench arm 22 is pivotally mounted about a pivot pin coupled to the main body 16 by means of a socket head cap screw 20.

The end of the wrench arm 22 opposite the wrench head 12 has a cam surface 24 formed therein. A roller assembly 26 engageable with the cam surface 24 combines therewith to form the release mechanism for the torque wrench illustrated in FIG. 1. The release mechanism illustrated in FIG. 1 can be actuated in either direction, that is, the release mechanism accommodates both "right hand" and left hand" releases.

The roller assembly 26 includes a roller cage 28 and three barrel rollers 29, 30 and 31 mounted within the roller cage 28. The forward barrel roller 29 engages the cam surface 24. The roller assembly 26 is urged towards cam surface 24 by a compression spring 32 acting against a spring guide 33. The rearward barrel rollers 30 and 31 provide rolling contact for the roller assembly 26 with the interior surfaces of the main body 16 while barrel roller 29 is provided for rolling contact with the cam surface 24.

When a predetermined amount of torque determined by the extent of compression of the spring 32 is exceeded, the end of wrench arm 22 adjacent the cam surface 24 moves toward the inner wall of the main body 16 in the direction opposite from the applied force. When the wrench arm 22 contacts the interior surface of the main tube body 16 an audible signal or click informs the operator of the torque wrench that the predetermined torque has been achieved. It is clear from the construction of the release mechanism in FIG. 1 that the wrench arm 22 can release in either direction depending on the direction of the applied force.

The end of the compression spring 32 opposite the spring guide 33 is connected to a slider 26. The movement of the slider 36 is used to adjust the torque setting of the wrench. The slider carries an indicator line or mark (not shown) which can be viewed through one or more calibrated windows (also not shown) in main body 16 to provide a visual indication of the torque setting.

A mechanism is further provided for providing fine calibration adjustment of the wrench. That mechanism includes a socket set screw 35 and a socket set screw lock 37, each of which engages a threaded portion of the slider 36. The socket set screw 35 is accessible through a counterbore 39 in the slider in order to set the spring guide 33 in a precise position. A ball 38 is disposed between the set screw 35 and the set screw lock 37. Upon tightening of the set screw lock 37, the ball 38 applies a force to both the set screw 35 and the set screw lock 37 to force the threads of those members against the threads of slider 36, to hold them against movement relative to slider 36. This maintains the set screw 35 in the precise position set.

Figures 2, 3, 4:
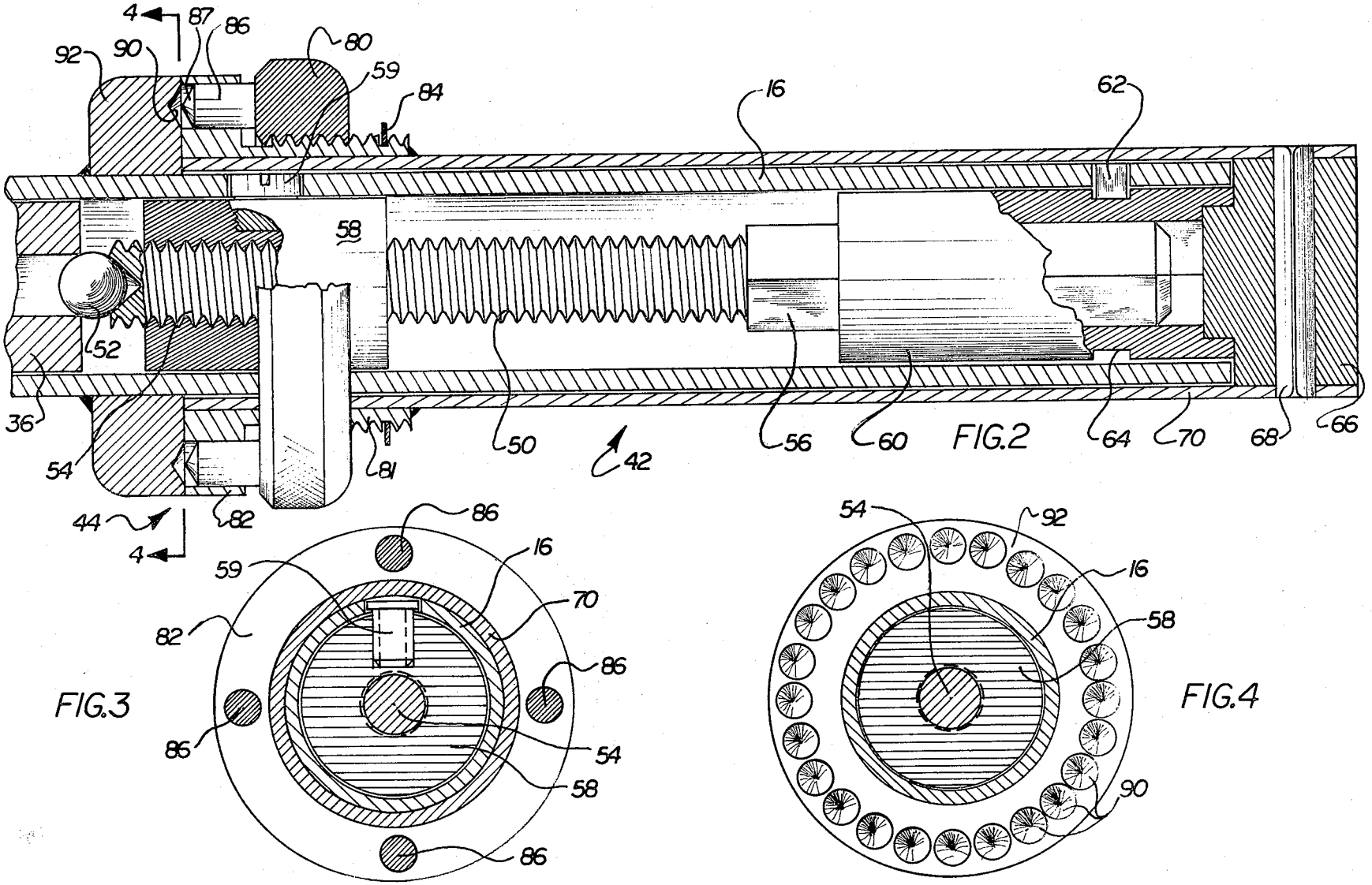
FIG. 2 is an enlarged view of the handle of the wrench illustrated in FIG. 1 with certain portions being illustrated in cross section along the longitudinal axis of the wrench.
FIG. 3 is a cross section along line 3—3 of FIG. 1.
FIG. 4 is a cross section along line 4—4 of FIG. 2.

The handle 42 of the torque wrench illustrated in FIG. 1 is associated with a locking mechanism 44, and a torque adjusting mechanism 46 is disposed within the main body 16. The locking mechanism 44 and the adjusting mechanism 46 will be explained in more detail in connection with FIG. 2. FIG. 2 is an enlarged view of the handle 42 of the wrench illustrated in FIG. 1 with certain parts shown in a cross section along the longitudinal axis of the main tube body 16. The locking mechanism 44 is illustrated in its "locked" or activated position in FIG. 1 and in its "unlocked" or deactivated position in FIG. 2.

A desired torque is established by moving the slider 36 along the axis of the main body 16 to set the effective spring force acting on the spring guide 33. The slider 36 is moved along the axis of the main body 16 in response to axial movement of an adjusting screw 50. The adjusting screw 50 is connected to the slider 36 through an adjusting ball pivot 52 which transmits axial but not rotational movement from the adjusting screw 50 to the slider 36. The adjusting screw 50 has a threaded portion 54 in contact with the adjusting ball pivot and a polygonally shaped end 56 at its other end. The polygonally shaped end 56 is preferably a hexagon.

The adjusting screw 50 threadedly engages a carrier block 58 disposed within the main body 60. The carrier block 58 is held stationary with respect to the main body 16 by an adjusting carrier block set screw 59. Thus, rotational movement of the adjusting screw 50 moves the adjusting screw 50 linearly along the axis of the main tube body 16 by virtue of the threaded engagement with the carrier block 58. The movement of the adjusting screw 50 linearly along the axis of the main body 16 in turn determines the amount of compression of the compression spring 32 that is desired according to the torque setting determined from the position of the indicator line on slider 36 shown against the scales on the calibration windows in the main body.

The polygonal end 5 of the adjusting screw 50 is slidably engaged within a mating polygonally shaped opening in another adjusting member 60. The opening in the adjusting member 60 is preferably of the same shape as the polygonally shaped end 56 of the adjusting screw 50 in order to transmit rotary motion between the adjusting screw 50 and the adjusting member 60.

Any suitable interlocking shape between the adjusting screw 50 and the adjusting member 60 can be utilized, but a polygonal shape, especially a hexagon, is preferred. Because of the central opening in the adjusting member 60, it is frequently referred to as the adjusting female member, e.g., the adjusting female hex.

The adjusting female hex 60 cannot move axially with respect to the main body 16 since it is held stationary with respect to the main body 16 by virtue of a member 62. The member 62 is preferably a Woodruff key which engages the main body 16 and extends into a peripheral groove 64 in the outer circumference of the adjusting female hex 60. The peripheral groove 64 in the adjusting female hex 60, of course, lies in a plane perpendicular to the longitudinal axis of the main body 16. Thus, member 62 permits rotational movement of the adjusting female hex 60 but precludes axial movement of the adjusting female hex with respect to the main body 16.

The operative connection between the adjusting screw 50 and the adjusting female hex 60 is such that they rotate together relative to the main body 16, but the hexagonal member 56 and adjusting screw 50 can move along the axis of the main body 16.

The adjusting female hex 60 is fixed, such as by welding or brazing, to an end plug 66. The end plug 66 is in turn fixed to an adjusting handle 70 by a roll pin 68 that extends through an opening in the end plug 66 into two openings in the adjusting handle 70 at opposite ends along a diameter through the end plug 66.

Therefore, it will be apparent that the adjusting handle 70, the end plug 66, and the adjusting female hex 60 will rotate as a unit. With the locking mechanism 44 in the deactivated or "unlocked" position as shown in FIG. 2, the adjusting handle 70 can be rotated about the outer surface of the main body 16. Rotation of the adjusting handle 70 causes the adjusting female hex 60 to rotate therewith by virtue of the fixed connection through end plug 66. Rotation of the adjusting female hex 60 in turn cause the hexagonal end 56 of the adjusting screw 50 to rotate with the adjusting female hex 60. In view of the threaded connection between the threaded portion 54 of the adjusting screw 50 with the stationary carrier block 58, the adjusting screw 50 is caused to move along the axis of the main tube body 16. During that movement along the axis, the polygonal end 56 rotates jointly with the adjusting female hex 60 and simultaneously moves along the axis of the main tube body 16 in sliding contact with the mating polygonal opening in the adjusting female hex 60.

When the locking mechanism 44 is in the "locked" or activated position as shown in FIG. 1, the adjusting handle 70 is immobilized and therefore the adjusting mechanism 46 cannot be moved. This, of course, assures that the torque setting remains at the desired setting. To deactivate the locking mechanism 44 into the "unlocked" or deactivated position as shown in FIG. 2, a threaded locking ring 80 can be threaded along a threaded portion 81 of a locking guide ring 82. The locking guide ring 82 is fixed to the adjusting handle 70, for example, by welding. Movement of the threaded locking ring 80 along the threaded portion 81 of the locking guide ring 82 is limited by a snap ring 84.

The locking guide ring 82 surrounds the main body and has a plurality of openings therethrough. Each opening containing a locking pin 86 slidably received therein. Four locking pins are illustrated in the torque wrench in the drawings, as best seen in FIG. 3. The locking pins 86 are essentially cylindrical in shape with one end 87 being shaped in the form of a cone. The cone shaped end 87 of each locking pin 86 is mounted for sliding movement into one of a plurality of conically shaped recesses 90 in locking block 92.

The recesses 90 in the locking block 92 are spaced about the periphery to provide many possible sites for engagement with the locking pins 86. The locking pins 86 can be moved through the locking guide ring 82 for engagement with the recesses 90 in the locking block 92 by threaded movement of the locking ring 80. Thus, after adjusting the adjusting mechanism 46 to achieve the desired torque setting, the adjusting mechanism 46 is immobilized by moving the threading locking ring 80 so that the locking pins 86 slide through the locking guide ring 82 and engage the recesses 90 in locking block 92. Conversely, threaded movement of locking ring 80 to the right as seen in FIG. 2 permits rotation of adjusting handle 70 which allows the locking pins 86 to slide out of the recesses and move axially within the holes in the guide ring 82.

Placement of a plurality of recesses 90 around the periphery of locking block 92 insures that the adjusting handle 70 will not have to be rotated very far, if at all, from the desired torque setting. Rotation of the adjusting handle 70 would have to take place in the event that the locking pins 86 were not lined up with one of the recesses 90 after setting the desired torque. For example, as seen in FIG. 4, 24 recesses 90 have been provided which insures that the adjusting handle 70 need not be rotated more than 7.5° from any desired setting.

From the operation of the torque wrench of the present invention as described above, it will be apparent that the overall length of the torque wrench from the work head 12 to the end plug 66 remains constant at all times whether or not the locking mechanism 44 is engaged or not and whether or not the adjusting mechanism 46 is being utilized. Keeping the wrench at a fixed length insures that the force is applied at the same point on the wrench and acts through the same distance to the wrench head 12. The fixed length aids in a more accurate torque response in accordance with the desired torque setting.

The locking mechanism 44 has a fixed location relative to the overall length of the wrench. The fixed location of the locking mechanism, and the larger diameter of the locking mechanism relative to the work head 12 and the handle 70 provide the operator with an obvious hand position for gripping the wrench. This further promotes consistent force application in accordance with the torque setting by ensuring a fixed length between the work head and the position at which the operator grips the wrench.

Of course, there may be constructional modifications of the torque wrench of the invention which may allow a shortening of its fixed overall length. For example, the slider 36 could be counterbored and the compression spring 32 disposed within the counterbore. This would utilize existing dead space to shorten the fixed overall length of the wrench. Further, it would resist lateral deflection of the compression spring.

Additionally, the adjusting mechanism 46 remains enclosed within the main body 16 and is not exposed during adjustment. Also, the arrangement of the locking mechanism 44 in combination with the adjusting mechanism 46 enclosed within the main tube body 16 provides a very durable torque wrench of relatively simple construction that is convenient and is easy to adjust. The locking mechanism is placed in a position that does not interfere with the operator's application of force to handle 70. The structure and placement of the locking ring on the exterior of the wrench provides a relatively large circumference for a multitude of locking positions, which assists in more accurate torque settings.

Figure 5:
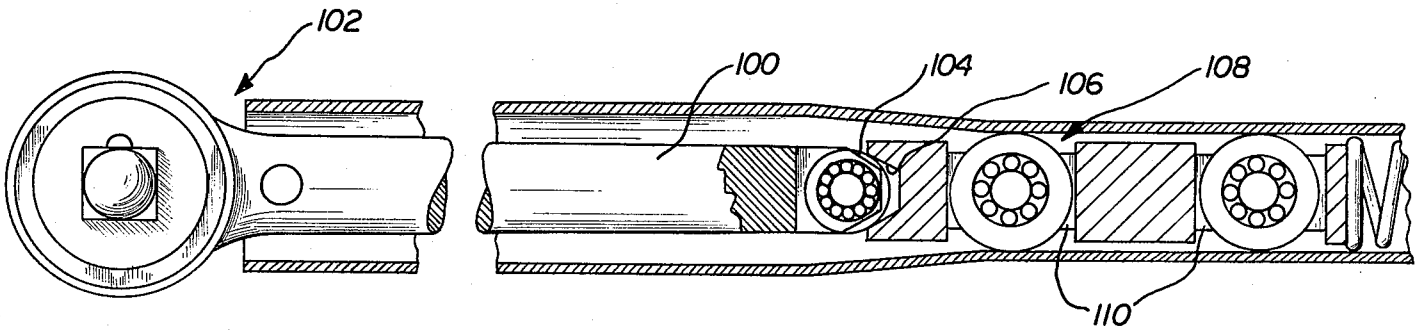
FIG. 5 is a longitudinally, fragmentary sectional view of the wrench end of a torque wrench according to a modified form of the invention.

FIG. 5 shows the wrench end of a torque wrench according to another preferred embodiment of the invention.

In the embodiment of FIG. 5, the end of the arm 100 opposite the wrench head 102 has a flat roller 104 mounted thereon. A cam 106 is carried at the adjacent end of the roller carrier assembly 108 and engages the roller 104. The cam 106 and roller 104 cooperate to provide release movement of the wrench arm, and an appropriate audible signal, when the predetermined torque is reached.

In the manufacture of the embodiment of FIG. 5, the roller carrier assembly can be made of square, hexagonal or round stock.

With the embodiment of FIG. 5, the cam 106 can be larger than with the previous embodiment, because it does not swing with the wrench arm, but rather only moves axially with the roller carrier assembly 108.

Thus, as set forth in the foregoing description, applicants have provided what is believed to be a new and useful torque wrench construction. While the preferred embodiments are described above, it is likely that from the applicants' description various obvious modifications utilizing the principles of the invention will become readily apparent to those of ordinary skill in the art.

What is claimed is:

1. A torque wrench comprising a main body having a fixed length, a first adjusting means mounted for relative rotational movement with respect to said main body and constrained against axial movement relative to said main body, a second adjusting means engaging said first adjusting means and operatively connected for joint rotational movement with said first adjusting means and for axial movement relative thereto, said first and second adjusting means being operatively connected to provide, in response to joint rotational movement of said first and second adjusting means relative to said main body, for axial movement of said second adjusting means with respect to said main body to provide an axially directed force for adjusting the torque setting of said wrench, locking means having an activated position preventing rotational movement of said first adjusting means and a deactivated position permitting rotational movement of said first adjusting means, said locking means and said first and second adjusting means being mounted with respect to said main body to maintain a fixed wrench length from a work head forming one end of said wrench to the opposite end of said wrench, whether said locking means is in either said activated or deactivated position, and regardless of the relative positions of the first and second adjusting means.

2. A torque wrench as defined in claim 1, said second adjusting means having a threaded portion threadedly engaged with a carrier means fixed with respect to said main body, said second adjusting means being operatively connected between said first adjusting means and said carrier means so that said second adjusting means moves axially with respect to said first adjusting means and said main body in response to joint rotational movement of said first and second adjusting means, said threaded engagement between said carrier means and said second adjusting means providing for axial movement of said second adjustment means in response to joint rotation of the first and second adjusting means.

3. A torque wrench as defined in claim 2 wherein said first adjusting means is mounted for rotation about the longitudinal axis of said main body and has a polygonal opening therein and said second adjusting means has a polygonal portion slidably received within said polygonal opening of said first adjusting means.

4. A torque wrench as defined in claim 3 wherein said first and second adjusting means comprise a male hexagonal member slidably received within a female hexagonal member.

5. A torque wrench as defined in claim 3 wherein said main body comprises a hollow tubular member, said first and second adjusting means being disposed within said hollow tubular member, and wherein said first adjusting means is fixedly connected to an adjusting handle mounted for rotational movement about the outer surface of said hollow tubular member.

6. A torque wrench as defined in claim 5 wherein said adjusting handle is constrained against axial movement relative to said main body.

7. A torque wrench as defined in claim 6 wherein said adjusting handle comprises a hollow tube surrounding said hollow tubular member of said main body, said hollow tube and said first adjusting means being constrained against axial movement relative to said main body by a member engaging said main body and extending into and engaging a peripheral groove in said first adjusting means.

8. A torque wrench as defined in claim 7 wherein said locking means comprises a locking block encircling said hollow tubular member and fixedly connected thereto, said locking block having a plurality of recesses formed in a surface thereof, a locking guide ring fixedly connected with said adjusting handle and disposed mounted adjacent to said locking block, said locking guide ring having a plurality of openings therethrough for alignment with respective recesses in said locking block, a plurality of locking pins slidably movable within respective openings in said locking guide ring, said locking pins being fixedly connected with a locking ring surrounding said adjusting handle, said locking guide ring having internal threads engaging external threads fixed with said adjusting handle so that rotational movement of said threaded locking ring relative to said adjusting handle moves said locking pins in said openings in said locking guide ring for engagement or disengagement with the recesses in said locking block.

9. A torque wrench as defined in claim 8 wherein each recess in said locking block has at least one tapered side surface and said locking pins have corresponding, tapered surfaces to provide for a camming action between the locking pins and the recesses in the locking block for disengaging the locking pins from the recesses in the locking block when said locking ring has been rotated to move said locking pins to a disengaged position and said adjusting handle and locking ring are rotated together.

10. A torque wrench as defined in claim 6 wherein said first adjusting means is fixedly connected to an end plug, and said adjusting handle is fixedly connected to said end plug.

11. A predetermined adjustable torque release wrench comprising a hollow main body having a fixed length between a first and second end thereof, a work head positioned adjacent said first end of said main body forming a first end of said wrench, an adjusting handle coaxially mounted adjacent said second end of said main body and a second end of said wrench, said adjusting handle being mounted for relative rotational movement about said main body and being constrained against axial movement relative to said main body, a first adjusting means mounted for relative rotational movement with respect to said main body about the longitudinal axis of said main body, said first adjusting means having a polygonal opening therein, a second adjusting means having a polygonal outer surface at one end thereof and a threaded portion adjacent the other end thereof, said second adjusting means having the polygonal end thereof slidably engaged within the polygonal opening of said first adjusting means for joint rotational movement with said first adjusting means and for axial movement of said second adjusting means relative to said first adjusting means, a carrier means fixedly mounted within said main body and having a threaded opening therethrough along the axis of said main body, said threaded portion of said second adjusting means threadedly engaged with said threaded opening of said carrier means and having the end of said second adjusting means adjacent said threaded portion operatively connected to a compression member, said first and second adjusting means and said carrier means being operatively connected to provide, in response to joint rotation of said first and second adjusting means relative to said main body for axial movement of said second adjusting means with respect to said main body and to said carrier means to axially move said second adjusting means to change the length of the compression member to affect the torque setting of said wrench, said adjusting handle being fixedly connected to said first adjusting means and mounted to rotate therewith with respect to the main body, locking means having an activated position preventing rotational movement of said adjusting handle and a deactivated position permitting rotational movement of said adjusting handle, said locking means being located adjacent a first end of said adjusting handle and operatively connected with said main body to lock the adjusting handle to said mai body when the locking means is in its activated position, said first and second adjusting means being disposed within said hollow main body said locking means and said first and second adjusting means being mounted with respect to said torque wrench to maintain a fixed wrench length between said work head forming the first end of said wrench and the second end of said wrench, regardless of whether said locking means is in either the activated or deactivated position and regardless of the relative positions of the first and second adjusting means.

12. A torque wrench as defined in claim 11 wherein said first adjusting means comprises a female hexagonal member and said second adjusting means comprises a male hexagonal member slidably received within said female hexagonal member.

13. A torque wrench as defined in claim 11 wherein said hollow main body comprises a hollow main tube, said adjusting handle comprising a hollow tube surrounding said hollow main tube, and means for restraining axial movement of said adjusting handle and said first adjusting means relative to said main tube.

14. A torque wrench as defined in claim 13 wherein said locking means comprises a locking block encircling said main tube and fixedly connected thereto, a plurality of recesses formed in a surface of said locking block and disposed to surround said main tube, a locking guide ring fixedly connected with said adjusting handle and disposed adjacent to said locking block, said locking guide ring having a plurality of openings therethrough for alignment with respective locking recesses in said locking block, a plurality of locking pins slidably movable within respective openings in said locking guide ring, said locking pins being fixedly connected with a locking ring surrounding said adjusting handle, said locking ring having internal threads engaging external threads on said adjusting handle so that rotational movement of said locking ring relative to said adjusting handle shifts said locking ring axially relative to said main tube and moves said locking pins in said openings in said locking guide ring for engagement or disengagement with the recesses in said locking block.

15. A torque wrench as defined in claim 14 wherein each recess in said locking block has at least one tapered side surface and said locking pins have corresponding, tapered surfaces to provide for a camming action between the locking pins and the recesses in the locking block for disengaging the locking pins from the recesses in the locking block when said locking ring has been rotated to move said locking pins to a disengaged position and said adjusting handle and locking ring are rotated together.

16. A torque wrench as defined in claim 11 wherein said first adjusting means is fixedly connected to an end plug, and said adjusting handle is fixedly connected to said end plug.

* * * * *

UNITED STATES PATENT AND TRADEMARK OFFICE

CERTIFICATE OF CORRECTION

PATENT NO. : 4,316,397

DATED : February 23, 1982

INVENTOR(S) : Ray C. Skidmore, et al.

It is certified that error appears in the above-identified patent and that said Letters Patent are hereby corrected as shown below:

Column 10, line 1, change "mai" to --main--.

Signed and Sealed this

*Twentieth* Day of *July 1982*

[SEAL]

*Attest:*

GERALD J. MOSSINGHOFF

*Attesting Officer*

*Commissioner of Patents and Trademarks*